United States Patent [19]

Delli-Gatti, Jr.

[11] 4,120,535

[45] Oct. 17, 1978

[54] SCOOP-BELT MINER

[75] Inventor: Frank A. Delli-Gatti, Jr., Beckley, W. Va.

[73] Assignee: Coaltex, Inc., Beckley, W. Va.

[21] Appl. No.: 794,647

[22] Filed: May 6, 1977

[51] Int. Cl.[2] ..... E21C 27/22; E21C 35/20

[52] U.S. Cl. ..... 299/18; 198/522; 198/812; 198/827; 299/56; 299/87

[58] Field of Search ..... 299/18, 19, 56, 57, 299/87; 198/522, 827, 812, 570

[56] References Cited

U.S. PATENT DOCUMENTS

| | | | |
|---|---|---|---|
| 1,295,173 | 2/1919 | Joy | 299/56 |
| 2,756,037 | 7/1956 | Kirkpatrick | 299/56 |
| 2,955,808 | 10/1960 | Kandle | 299/87 |
| 3,124,238 | 3/1964 | Tyler | 198/827 |
| 3,135,502 | 6/1964 | Muehlman | 299/56 |
| 3,289,816 | 12/1966 | Baechli | 198/812 |
| 3,661,246 | 5/1972 | Faunce et al. | 198/842 |

*Primary Examiner*—Ernest R. Purser
*Assistant Examiner*—William F. Pate, III
*Attorney, Agent, or Firm*—Cushman, Darby & Cushman

[57] ABSTRACT

A mining machine that may be used in place of an auger miner that is much more energy efficient in transporting mined material from the cutting site to the mouth of the mine. The machine includes a non-rotatable body member with stabilizers, at least one rotatable pilot cutting head mounted in front of the body member and a shaft operatively connected to the cutting head for rotation thereof, and a conveyor assembly mounted behind the pilot head in operative association with the body member. The conveyor assembly includes a scoop disposed posteriorly of the cutting head and having a bottom portion abutting the floor and extending posteriorly therefrom at an angle of about 14° or less, and having side members that funnel toward each other. The conveyor assembly further includes at least one auger section associated with the shaft located posteriorly of the pilot head and having a continuously decreasing flight diameter, and a conveyor belt disposed posteriorly of the scoop and extending to the mouth of the bore. Add-on sections are provided for mounting the conveyor belt as the mining machine progresses, the belt comprising an endless belt received by a take-up unit which lets out the amount of belt necessary given the distance of the cutting head from the bore mouth. More than one cutting head may be provided, with cutter bits disposed for engaging the bore floor and cutting any cusp left on the floor by the cutting heads.

26 Claims, 6 Drawing Figures

SCOOP-BELT MINER

BACKGROUND AND SUMMARY OF THE INVENTION

The invention relates to a mining machine that is utilizable in place of a conventional auger miner, and a method of continuously mining material from a bore and transporting it to the bore mouth. Conventional auger miners are useful for mining coal or the like from seams, however if the seam is long a heavy energy penalty is paid for the conveyance of the coal from the cutting site to the bore mouth when auger mining is utilized. According to the present invention, the energy needs for transporting cut coal or the like from the cutting site to the bore mouth are greatly reduced as compared to conventional auger mining, and additionally a much wider bore can be formed than is possible with conventional auger mining.

According to the present invention an endless conveyor belt is utilized instead of an auger for conveyance of the mined material from the cutting site to the bore mouth. Accordingly the method of the invention comprises the steps of cutting material in the bore to lengthen the bore, scooping the cut material and funnelling it onto the conveyor belt, supporting the conveyor belt at predetermined lengths therealong, adding supporting sections for the conveyor belt at the bore mouth as the bore lengthens, providing the necessary length of conveyor belt as the bore lengthens so that the conveyor belt always extends from adjacent the cutting site to the bore mouth, and transporting the mined material from the cutting site to the bore mouth with the conveyor belt. The steps of adding the supporting sections and providing more conveyor belt may be accomplished without interruption of the conveyance of mined material by the conveyor belt according to the present invention so that mining may be continuous, or even if mining is not continuous the conveyance of the cut material is. The power source for effecting cutting and advancing of the conveyor belt in response to the bore lengthening is preferably provided at the bore mouth, at least one shaft extending from the bore mouth to the cutting site, and the step of adding supporting sections for the conveyor belt at the bore mouth as the bore lengthens is accomplished simultaneously with the step of providing add-on sections for the at least one shaft so that shaft extends from the bore mouth to the cutting site.

A mining machine according to the invention includes a non-rotatable body member with stabilizing means for insuring non-rotative movement of the body member in a bore, at least one rotatable pilot cutting head mounted in front of the body member and means for rotating the cutting head including a rotatable shaft operatively connected to the cutting head, and conveying means mounted behind the pilot head in operative assocation with the body member for conveying material cut by the pilot head away from the cutting site. The conveying means comprises scoop means disposed posteriorly of the cutting head and having a bottom portion substantially abutting the bore floor and then extending posteriorly therefrom at a positive angle, and having side members that funnel toward each other. The conveying means also comprises at least one auger section associated with the shaft for rotation of the pilot head and located posteriorly of the pilot head and having a continuously decreasing flight diameter (extending away from the pilot head), and disposed above the scoop means bottom portion for conveying cut material up the bottom porytion; and a conveyor belt disposed posteriorly of the scoop means and extending to the bore mouth, said scoop means bottom portion and side members funnelling toward the conveyor belt, and a top, transporting surface of the conveyor belt being disposed adjacent the termination of the scoop means bottom portion and side members, said at least one auger section also terminating before said conveyor belt. More than one cutting head may be provided with two shafts extending frofm the cutting heads, one shaft disposed on either side of the conveyor belt and extending to the bore mouth. A power source is located at the bore mouth for rotation of the shafts and for movement of the cutting heads, body member, and entire assembly forwardly as boring progesses. The conveyor belt includes an anterior portion adjacent the scoop means including a plurality of rollers which are of a solid metal core with resilient material coating, and portions of the conveyor belt posterior of said conveyor belt anterior portion include rollers forming a trough and supporting the conveyor belt transporting surface thereon. Add-on sections are provided for supporting the conveyor belt at predetermined positions along the length thereof, each add-on section including vertically extending supports for supporting the trough-forming rollers, and bushing collars for supporting the shafts. The connection of the trough-forming rollers to the vertically extending supports is readily releasable so that an add-on section may be lowered over the conveyor belt and the trough-forming rollers readily attached to the vertically extending sections. A belt take-up unit provides the necessary length of belt as the bore lengthens so that the conveyor belt always extends from adjacent the cutting site to the bore mouth.

It is the primary object of the present invention to provide a mining machine that efficiently conveys cut material from the cutting site to the bore mouth, and one that may mine a relatively wide bore. This and other objects of the invention will become clear from an inspection of the detailed description of the invention, and from the appended claims.

BRIEF DESCRIPTION OF THE INVENTION

Figure 1:
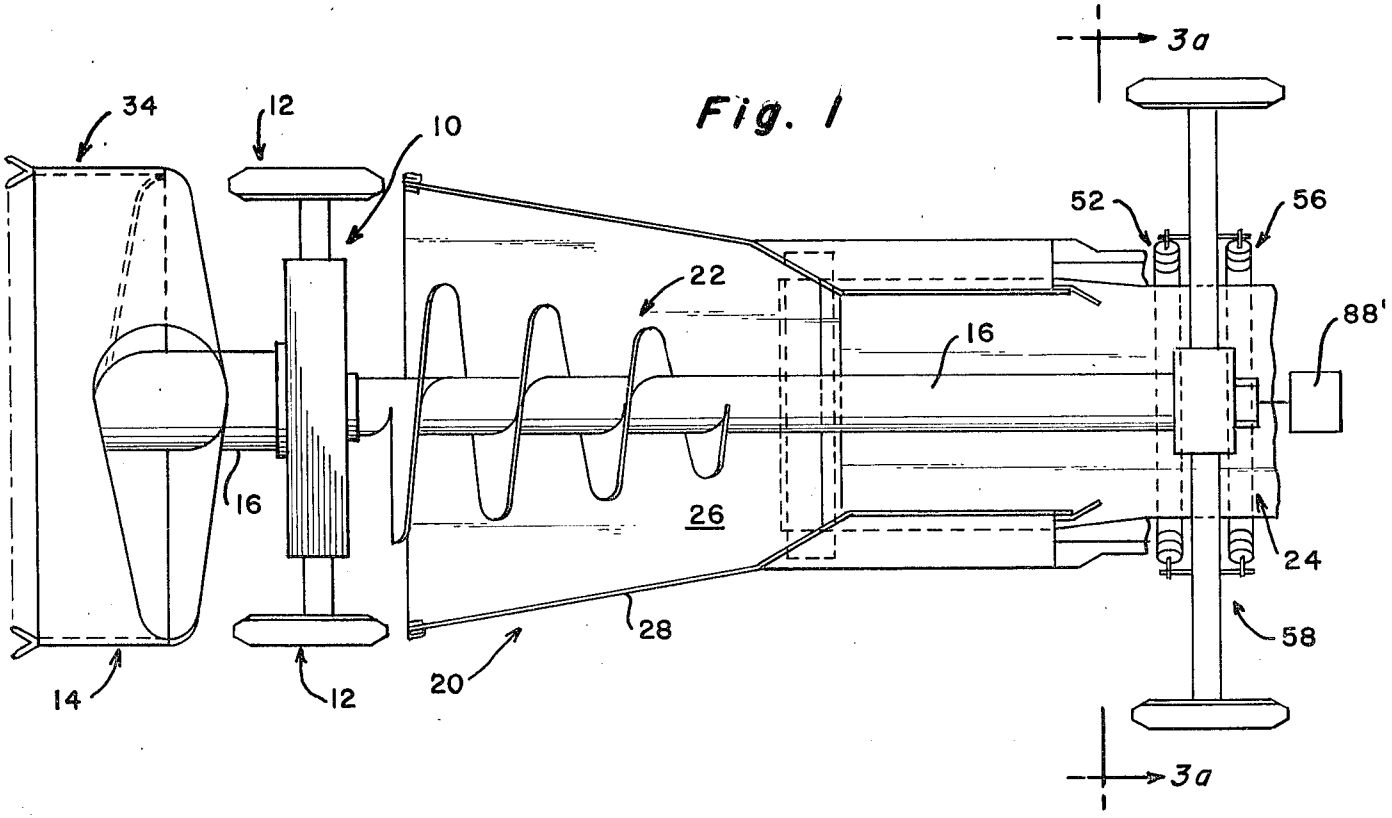
FIG. 1 is a top plan view of a mining machine according to the present invention cut away at an anterior portion of the conveyor belt.
Figure 3A:
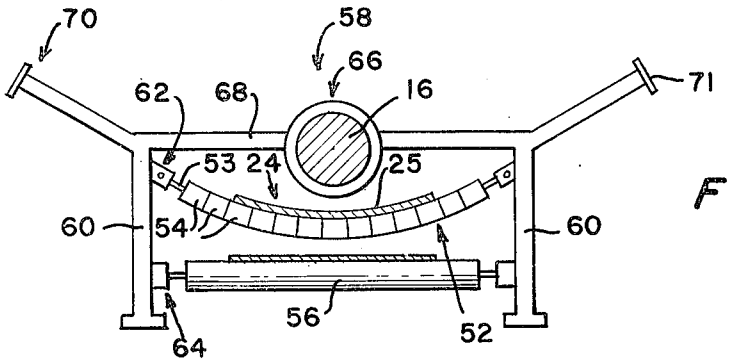
Figure 3B:
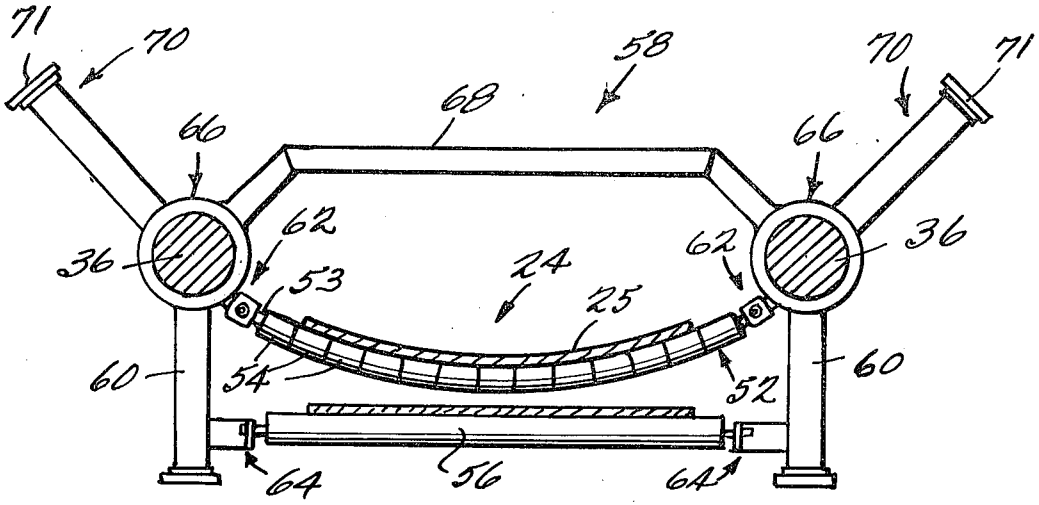
Figure 4:
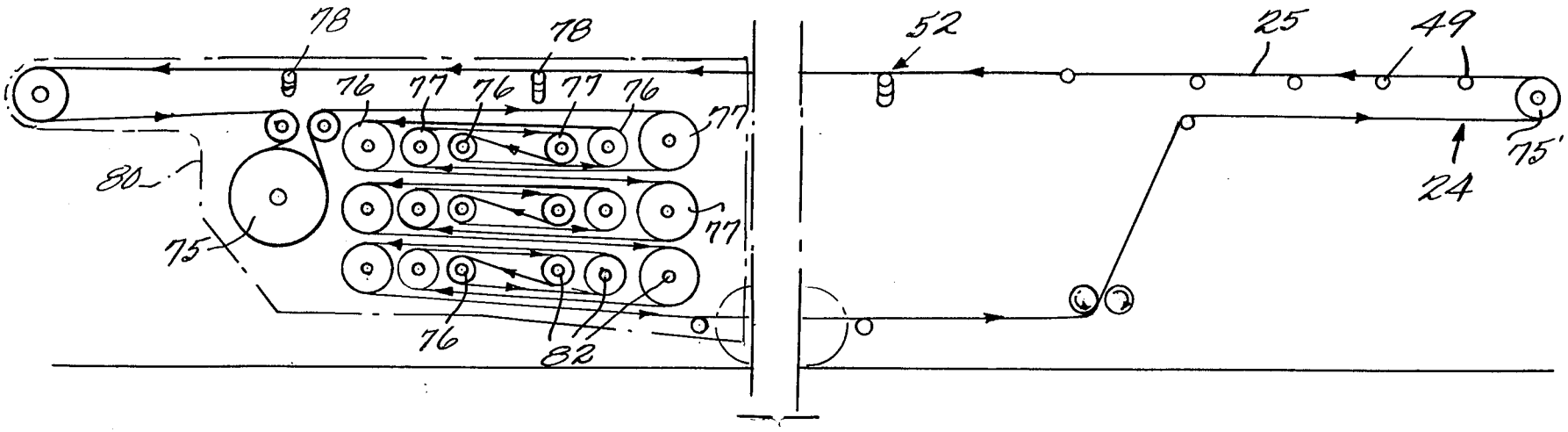
Figure 5:
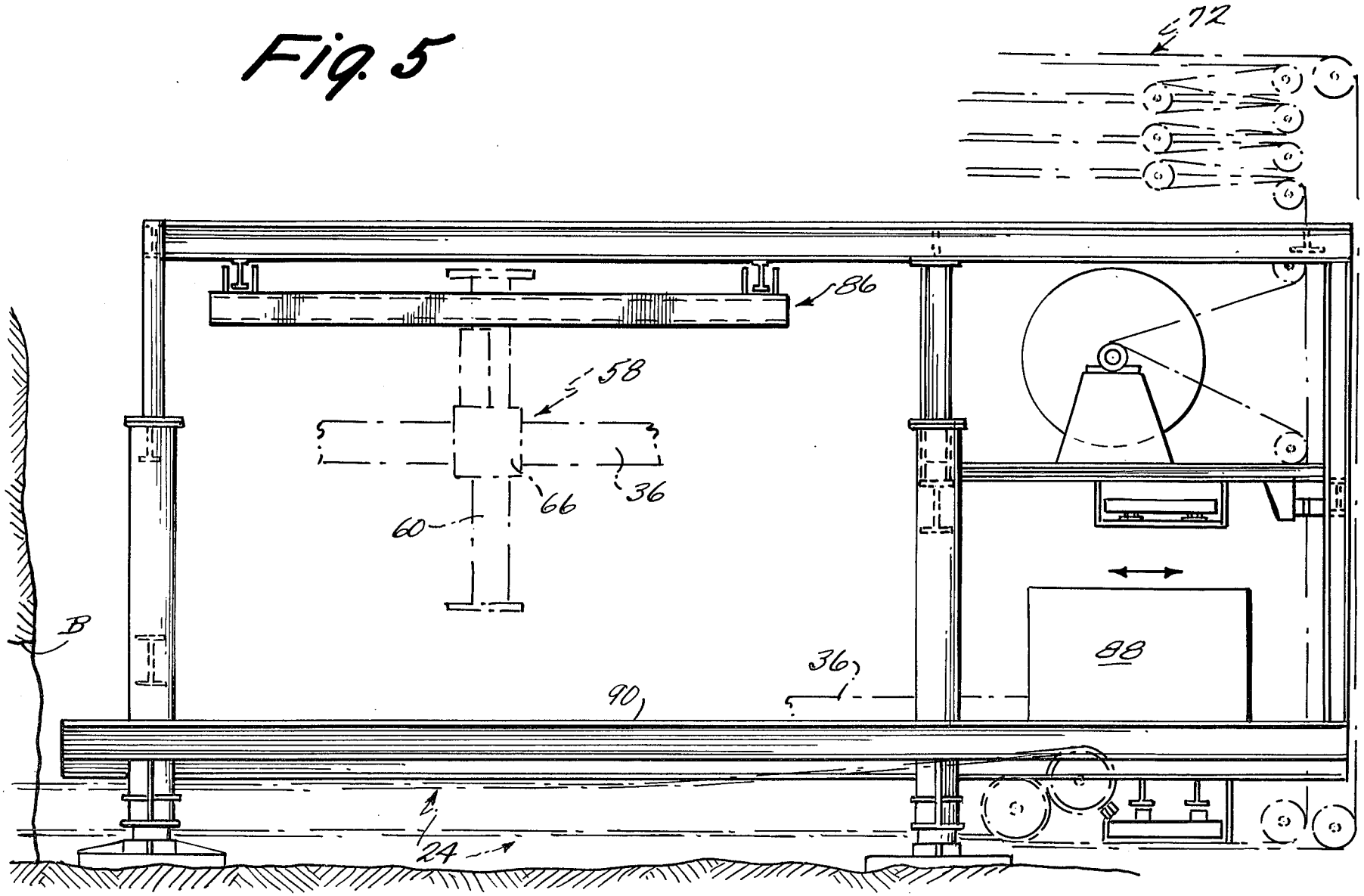

FIG. 3*a* is an end view, partly in section and partly in elevation, taken along lines 3*a*—3*a* of FIG. 1;

FIG. 3*b* is an end view, partly in section and partly in elevation, taken along lines 3*b*—3*b* of FIG. 1;

FIG. 4 is a schematic showing of the conveyor belt and take-up unit according to the present invention; and FIG. 5 is a schematic showing of a frame support for adding on sections for conveyor belt support for effecting the method according to the invention.

DETAILED DESCRIPTION OF THE INVENTION

The mining machine according to the present invention includes a non-rotatable body member 10 having stabilizing means 12 for ensuring non-rotative movement of the body member 10 in a bore B (see FIG. 5). At least one rotatable pilot cutting head 14 is mounted in front of the non-rotatable body member 10, and means are provided for rotating the at least one cutting head 14, said rotating means including a rotatable shaft 16 operatively connected to the cutting head 14. Conveying means 18 are mounted behind the pilot head in operative association with the body member 10 for conveying material cut by the pilot head 14 away from the cutting site, the conveying means 18 including scoop means 20 disposed posteriorly of the cutting head 14, at least one auger section 22 on the shaft 16 for rotation of the pilot head 14, and located posteriorly of the pilot head 14, and a conveyor belt 24 disposed posteriorly of the scoop means 20 and extending to the bore mouth (see FIG. 5). The conveyor belt includes a top transporting surface 25. The scoop means 20 includes a bottom portion 26 substantially abutting the bore floor and extending posteriorly therefrom at a positive angle $\alpha$, and having side members 28 that funnel toward each other and toward the conveyor belt 24. The angle $\alpha$ preferably is about 12° to effect optimum operation, although any angle $\alpha$ less than about 14° is operable to effect proper conveyance of the cut material. The at least one auger section 22 includes a continuously decreasing diameter flight 30 extending away from the pilot head, and disposed above the scoop means bottom portion 26 for conveying cut material up the bottom portion 26.

The scoop means 20 may have the portions 26, 28 thereof shaped as necessary in order to conform properly to a bore B formed by the at least one cutting head 14.

Figure 2:
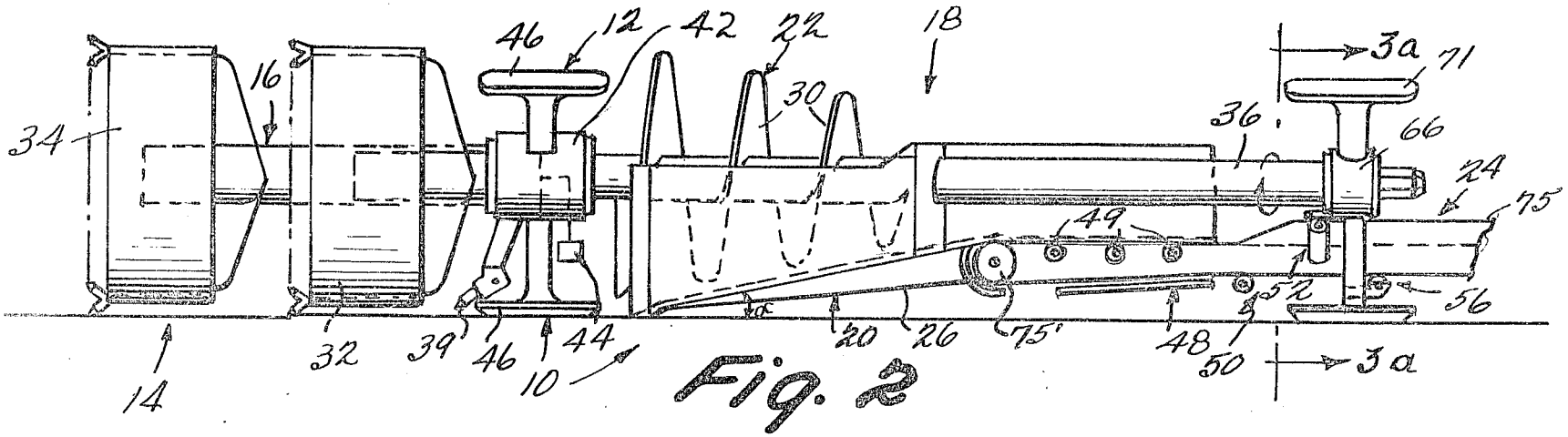
FIG. 2 is a side view of a modified form of the machine of FIG. 1.

More than one rotatable cutting head may be provided in order to cut a wide swath, such as when mining coal in a seam; more than one rotatable cutting head is shown in FIG. 2, including one or more end cutting heads 32 and a middle head 34, the middle cutting head 34 being disposed anteriorly of the one or more end heads 32. The heads 34, 32 may be at the same horizontal position if desired. The heads are rotatable about parallel axes and the cutting area of each head overlaps the cutting area of an adjacent head. A pair of power shafts 36 are then provided (see FIG. 3*b*), one disposed on either side of the conveyor belt 24, and a decreasing diameter auger section flight 30 is associated with each shaft 36. One more conical cutter bits 39 (see FIG. 2) may be disposed posterior of the cutting heads 32, 34 and anterior of the scoop means 20, the cutter bits 39 being mounted at the areas of overlap of the cutting heads 32, 34 for engaging the bore floor and cutting any cusp left on the floor by the cutting heads so that the scoop means bottom portion 26 may smoothly ride on the bore floor.

A chain drive means contained within a chain transmission case 42 may be provided for supplying power to head 34 from shafts 36 when two heads 32 are provided straddling head 34. The chain transmission case 42 may be considered to be a non-rotatable body member 10 in this embodiment. A decreasing diameter auger section flight 30 is associated with the middle pilot head 34 posterior of the case 42. In all embodiments, skids 46 are provided mounted on the meas 10 for providing the stabilizing means 12, and hydraulic means 44 (see FIG. 2) are provided for moving the skids 46 relative to the means 10 to ensure centering of the pilot head(s) in the bore. If desired, sensing means may be provided on the cutting head(s) for automatically effecting operation of the hydraulic means 44 should the cutting head(s) start to go out of a coal seam, effecting automatic centering of the cutting head(s) within the seam.

The conveyor belt 24 has an anterior portion 48 adjacent the scoop means 20 comprising a plurality of rollers 49 supporting the conveyor belt top transporting surface 25 thereon. Each of the rollers 49 may comprise a roll of solid metal (i.e., hardened steel) with a rubber or other resilient material coating. The provsion of such rollers is desirable in order to minimize the adverse effects from the mined material impacting on the conveyor belt 24 at this anteriormost portion of the conveyor belt. The rest of the conveyor, except for the anteriormost portion, is supported by rollers 52 which cooperate with the conveyor belt 24 to form a curved conveying surface or trough to ensure the retention of mined material thereon. Each trough-forming roller 52 (see FIGS. 3*a* and 3*b* in particular) comprises a flexible shaft 53 and a plurality of segmented resilient roller members 54 supported by the shaft 53. Bottom idler rollers 56 are provided associated with each roller 52 for supporting the bottom surface of the conveyor belt 24.

In order to ensure that the conveyor belt will always extend from the cutting site to the bore mouth during advancement of the cutting head(s), add-on sections 58 are provided for supporting the conveyor belt 24 at predetermined positions along the length thereof. FIG. 3*a* shows such sections 58 for the one pilot cutting head embodiment of FIG. 1, while FIG. 3*b* shows such sections 58 for the multiple-cutting head embodiment of FIG. 2. Each add-on section comprises a pair of vertically extending supports 60, one disposed on either side of the conveyor belt 24, and readily detachable means 62, 64 for connection of the rollers 52, 56 respectively, to the upstanding portions 60. The connections 62, 64 may readily be disconnected and the rollers 52, 56 withdrawn from engagement with the conveyor belt 24 while the portions 60 still straddle the conveyor 24. The rollers 52, 56 are then readily brought into operative association with the conveyor belt 24 — and this may be accomplished even during operation of the conveyor belt 24 — by merely passing the roller 52 between the upper and lower surfaces of the conveyor belt and attaching it at 62, and attaching the roller 56 at 64 underneath the lower conveyor belt surface. Each add-on section also preferably comprises one (FIG. 3*a*) or a pair (FIG. 3*b*) of bushing collars (anti-friction bearing assemblies) 66, one associated with each shaft (16,36), and preferably a cross bar 68 connects the portions 60. The shaft 16 (FIG. 3*a*), or the shafts 36 (FIG. 3*b*) extend through the bushing collars 66 so that the shafts extend from the cutting site to the bore mouth. Additionally, the unit 58 includes stabilizing means 70 including skids 71 for engaging the bore B that is formed.

The conveyor belt 24 is an endless conveyor, and a take-up unit 72 (see FIGS. 4 and 5) is provided at the bore mouth for providing the necessary length of conveyor belt as the bore is lengthened so that the conveyor belt always extends from adjacent the cutting site to the bore mouth. The conveyor belt and take-up unit 72 alone are shown in FIG. 4, however it is to be understood that FIG. 4 is only a diagrammatic showing and that the conveyor belt is supported within the bore as shown in FIGS. 1 through 3. The take-up unit may comprise a conventional structure having a series of varying diameter rollers 74 about which the belt 24 is laced so that the length of the belt outside the take-up unit may be automatically adjusted. The rollers 74 comprise alternately arranged smooth face 76 and spiral space 77 rollers, with the belt 24 interlaced therebetween as shown in FIG. 4. In addition to having avarying diameters the rollers 74 may also have varying lengths, the lengths and diamters arranged so that a maximum amount of belt may be stored within a minimum amount of space. A drive roller 75 is provided for powering the belt in the take-up unit 72, and cooperates with the drive roller 75= mounted adjacent the scoop means 20 in front of the conveyor belt 24. A casing 80 — which is shown only in partial form and in dotted line in FIG. 4 — may be provided for retaining the roller 74, and idler rollers 78 support the top of the conveyor belt 24 in the take-up unit 72. The shafts 82 for mounting the rollers 76, 77 are horizontally reciprocal so that the rollers may be moved relative to each other and thereby control the amount of belt disposed outside of the casing 80 relative to inside the casing. When the shafts 82 of each vertical level of rollers are moved closer together more belt is available outside of the casing 80, while when they are moved further apart belt from outside the casing is taken up by the rollers. Movement of the shafts 82 relative to each other may be effected automatically or manually.

A supporting frame member 84 for mounting the take-up unit 72 and for facilitating add on of the add-on sections is shown in FIG. 5. The supporting frame 84 is located adjacent the mouth of the bore B, and conveyed cut material is transported from the bore and is deposited at any desirable position adjacent the frame 84. A lifting mechanism 86 may be directly assoicated with the frame member 84, and a power source 88 for effecting rotation of the shaft 36 and for effecting advancement of the cutting heads 14, body member 10, and conveying means 18 may also be provided on the supporting frame 84. An add-on section 58 is shown in dotted line in FIG. 5 being held by the lifting mechanism 86. The power source may be of the type that rotates the shaft 16 or the shafts 36 and at the same time may sump the shafts and advance the whole cutting mechanism, the power source 88 being reciprocated along rails 90 to effect sumping. The conveyor belt 24 automatically is released from the take-up unit 72 in response to movement of the power source 88 as the entire machine is advanced in lengthening the bore B. Once the power source 88 has sumped the entire cutting arrangement as far as is possible, and/or when it is otherwise desirable to provide another add-on section 58 to properly support the conveyor belt 24, the power source 88 is detached from the shaft 16 or shafts 36 and moved to the position shown in solid line in FIG. 5. An add-on section 58 with additional shaft lengths is lowered by the lifting mechanism 86 so that the vertical upstanding portions 60 straddle the conveyor belt 24 (see FIG. 3), the rollers 52, 56 being detached from the portions 60 during lowering of the add-on mechanism 58 into place. The rollers 52 and 56 are then connected up to the portions 60 by the readily detachable connecting means 62, 64, and the shaft sections 36 are connected up to the end portion of the shafts leading to the cutting heads 32, while the read end(s) of the shaft 16 or the shafts 36 is (are) connected up to the power source 88. The power source 88 then again provides for rotation of the cutting head(s) and by reciprocal movement of the source 88 the cutting head(s) is (are) sumped into the bore B lengthening the bore B. During addition of an add-on section 58, the conveyor 24 may continue running if desired.

While it is desirable to have the power source 88 located at the bore mouth, under some circumstances it is possible to locate the power source directly behind the scoop means 20 as shown diagrammatically at 88′ in FIG. 1. The power source 88′ could be an electrically powered motor or the like that was mounted on crawlers or wheels which both rotated the shaft(s) 16 (36) and sumped the pilot cutting heads 14. Power lines would lead from the bore mouth to the power source 88′.

The machine according to the present invention having been described, a method of continuously mining material from a bore according to the present invention will now be set forth:

According to the present method, material is continuously mined from a bore and transported to the bore mouth utilizing an endless conveyor belt 24 extending from the bore adjacent the cutting site to the bore mouth. The method comprises the steps of cutting material in the bore to lengthen the bore (with at least one pilot cutting head 14), scooping the cut material and funnelling it onto the conveyor belt 42 (with scooping means 20 and auger sections 22), supporting the conveyor belt at predetermined lengths therealong (with rollers 52, 56), adding supporting sections (58) for the conveyor belt 24 at the bore mouth as the bore lengthens, providing the necessary length of conveyor belt as the bore lengthens (with take-up units 72) so that the conveyor belt 24 always extends from adjacent the cutting site to the bore mouth, and transporting the mined material from the cutting site to the bore mouth with the conveyor belt 24. The steps of adding supporting sections (58) and providing more conveyor belt may be accomplished without interruption of the mined material conveying operation of the conveyor belt 24. Additionally, the power source 88 for effecting cutting and advancing of the conveyor belt in response to bore lengthening may be provided at the bore mouth, at least one shaft 16 (36) extending from the bore mouth to the cutting site, and the step of adding supporting sections for the conveyor belt at the bore mouth as the bore lengthens may be accomplished simultaneously with the step of providing add-on sections for the at least one shaft 16 (36) so that the shaft extends from the bore mouth to the cutting site.

In a typical operation, the cutting heads 32, 34 would bore into a mine site, such as a coal seam, a relatively wide bore being formed thereby, and the cutters 39 would cut any cusp left between the overlapping areas of the cutting heads 32, 34. The cutting heads 32, 34 would be sumped as cutting continued, and the cut material would be moved up on the scoop means 20 bottom portion 26 as the machine advanced in the bore, the decreasing diameter auger section flights 30 distributing the mined material and moving it upwardly on the bottom portion 26 up to the start of the conveyor belt 24. The sides 28 of scoop means 20 act with the bottom 26 to funnel the mined material onto the anteriormost portion 48 of the conveyor belt 24, the rollers 49 supporting the belt 24 to minimize adverse effects of the mined material impacting on the belt 24.

The mined material is transported by the transporting surface 25 of the conveyor belt 24 from the cutting site to the bore mouth, supporting rollers 52 forming a trough to ensure that the mined material is retained on the conveyor 24 during transporting. As the cutting heads 32, 34 are advanced in the bore B, the necessary conveyor belt length 24 is automatically provided by relative movement of the shafts 82 of the rollers 74 in the belt take-up unit 72. Whenever it is desirable or necessary to provide another supporting section for the belt 24 or an additional shaft section leading from the power source 88 to the cutting head(s), an add-on section is lowered into cooperation with the belt 24 at the bore mouth so that the vertically upstanding portions 60 of the add-on section 58 straddle the belt 24, the rollers 52, 56 associated with that add-on section are connected up to the portions 60, and the shaft(s) is (are) connected up to again supply power from the power source 88 to the head(s) 14.

Although the method and machine according to the present invention provide mining in a simple and generally continuous manner much like conventional auger miners, the present invention has numerous advantages over conventional auger miners. According to the invention, a wider bore can be mined, and a longer bore can be mined. The cutting heads can be guided to stay in the coal seam and the coal cutting power is separated from the coal conveying power. Auger machines are limited to about 150 to 200 feet of depth as the power is limited to coal conveying friction and maximum power capacity of the drive tube, however according to the present invention there is no power limit as the coal cutting requirement remains constant and the belt conveyors can reach up to 5,000 feet in length with only a 60 horsepower motor. Recovery rates can be higher than in auger miners, and coal can be mined in zones that are lost to deep underground mining and strip mining. The machine of the invention would be economical to build because all expenses of spiral sections of a conventional auger are eliminated, and smaller power units may be used. Additionally, the invention provides safe working conditions since the operators are outside of the bore being formed.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A mining machine comprising (a) a non-rotatable body member, with stabilizing means for insuring non-rotative movement of said body member in a bore, (b) at least one rotatable pilot cutting head mounted in front of said non-rotatable body member, and means for rotating said cutting head including a rotatable shaft operatively connected to said cutting head, (c) conveying means mounted behind said pilot head in operative association with said body member, for conveying material cut by said pilot head away from the cutting site, said conveying means comprising (i) scoop means disposed posteriorly of said cutting head and having a flat, leading bottom portion substantially abutting the bore floor and then extending posteriorly therefrom at a positive angle, and having side members that funnel toward each other, (ii) at least one auger section associated with said shaft for rotation of said pilot head, and located posteriorly of said pilot head and having a continuously decreasing diameter flight extending away from said pilot head, and disposed above said scoop means bottom portion for conveying cut material up said bottom portion, and (iii) a conveyor belt disposed posteriorly of said scoop means and extending to the bore mount, said scoop means bottom portion and side members funnelling toward said conveyor belt, and a top, transporting surface of said conveyor belt being disposed adjacent the termination of said scoop means bottom portion and side members, said at least one auger section terminating anteriorly of said conveyor belt, and (d) said stabilizing means disposed between said at least one cutting head and said scoop.

2. A machine as recited in claim 1 wherein said conveyor belt includes an anterior portion adjacent said scoop means comprising a plurality of rollers supporting said conveyor belt.

3. A machine as recited in claim 2 wherein said conveyor belt includes portions posterior of said anterior portion comprising rollers forming a trough and supporting said conveyor belt transporting surface.

4. A machine as recited in claim 2 wherein each of said rollers comprises a solid metal core portion with a resilient material coating.

5. A machine as recited in claim 1 wherein said conveyor belt comprises a plurality of rollers forming a trough and supporting said conveyor belt conveying surface.

6. A machine as recited in claim 5 further comprising a plurality of add-on sections for said shaft and said conveyor belt, said add-on sections each comprising vertically extending supports for supporting said trough-forming rollers, stabilizing means for engaging the formed bore, and a bushing collar supported by said vertically extending supports for mounting said shaft.

7. A machine as recited in claim 1 wherein said scoop belt bottom portion is disposed at an angle of less than about 14° with respect to the bore floor.

8. A machine as recited in claim 7 wherein said scoop means bottom portion angle is about 12°.

9. A machine as recited in claim 1 wherein said conveyor belt is operatively associated with a belt take-up unit, said conveyor belt comprising an endless belt, and said take-up unit comprising a series of varying diameter rollers about which said belt is laced so that the length of said belt outside said take-up unit may be automatically adjusted.

10. A machine as recited in claim 9 wherein said rollers of said take-up unit are alternately arranged smooth face and spiral face rollers.

11. A machine as recited in claim 9 wherein said take-up unit is mounted on a frame member for providing add-on sections for said shaft, stabilizing means being associated with each shaft add-on section.

12. A machine as recited in claim 1 further comprising power means for adjusting said stabilizing means for effecting steering of said cutting head.

13. A mining machine comprising (a) a non-rotatable body member, with stabilizing means for ensuring non-rotative movement of said body member in a bore, (b) at least two rotatable circumferentially continuous cutting heads rotatable about parallel axes, the cutting areas of each head overlapping the cutting area of an adjacent head, and means for rotating each of said cutting heads including at least one rotatable shaft operatively connected to said cutting heads, and (c) conveying means mounted behind said cutting heads in operative association with said body member, for conveying material cut by said pilot cutting heads away from the cutting site, said conveying means comprising (i) scoop means disposed posteriorly of said cutting heads and having a bottom portion substantially abutting the bore floor and then extending posteriorly therefrom at a positive angle, and having side members that funnel toward each other, (ii) at least one auger section associated with said at least one shaft for rotation of said pilot heads, and located posteriorly of said pilot heads and having a continuously decreasing diameter flight extending away from said pilot heads, and disposed above said scoop means bottom portion for conveying cut material up said bottom portion, and (iii) a conveyor belt disposed posteriorly of said scoop means and extending to the bore mouth, said scoop means bottom portion and side members funnelling toward said conveyor belt top, and a top, transporting surface of said conveyor belt being disposed adjacent the termination of said scoop means bottom portion and side members, said at least one auger section terminating anteriorly of said conveyor belt.

14. A machine as recited in claim 13 further comprising at least one conical cutter bit disposed posterior of said cutting heads and anterior of said scoop means, one said cutter bit being mounted at each area of overlap of said cutting heads, for engaging the bore floor and cutting any cusp left on the floor by said cutting heads.

15. A machine as recited in claim 13 wherein a pair of drive shafts are provided, one disposed on either side of said conveyor belt and wherein a decreasing diameter auger section flight is associated with each shaft.

16. A machine as recited in claim 15 further comprising a plurality of add-on sections for supporting said conveyor belt, each said add-on section comprising a trough-forming roller for supporting said conveyor belt conveying surface thereon, add-on sections for both of said shafts, a pair of bushing collars for mounting said shafts, and vertically extending supports for supporting said trough-forming roller and said bushing collars.

17. A machine as recited in claim 13 wherein a middle and two end cutting heads are provided, said middle cutting head being longitudinally displaced from said end cutting heads.

18. A mining machine comprising (a) a non-rotatable body member, with stabilizing means for insuring non-rotative movement of said body member in a bore, (b) at least one rotatable pilot cutting head mounted in front of said non-rotatable body member, and means for rotating said cutting head including a rotatable shaft operatively connected to said cutting head, and (c) conveying means mounted behind said pilot head in operative association with said body member, for conveying material cut by said pilot head away from the cutting site, said conveying means comprising (i) scoop means disposed posteriorly of said cutting head and having a bottom portion substantially abutting the bore floor and then extending posteriorly therefrom at a positive angle, and having side members that funnel toward each other, (ii) at least one auger section associated with said shaft for rotation of said pilot head, and located posteriorly of said pilot head and having a continuously decreasing diameter flight extending away from said pilot head, and disposed above said scoop means bottom portion for conveying cut material up said bottom portion, and (iii) a conveyor belt disposed posteriorly of said scoop means and extending to the bore mouth, said scoop means bottom portion and side members funnelling toward said conveyor belt, and a top, transporting surface of said conveyor belt being disposed adjacent the termination of said scoop means bottom portion and side members, said at least one auger section terminating anteriorly of said conveyor belt, and (iv) a plurality of add-on sections for supporting said conveyor belt, each add-on section comprising a trough-forming roller for supporting said conveyor belt conveying surface thereon, add-on sections for said at least one shaft, a bushing collar for mounting each shaft, and vertically extending supports for supporting said trough-forming roller and said at least one bushing collar.

19. A machine as recited in claim 18 wherein each of said add-on sections further comprises stabilizing means for engaging the formed bore, said stabilizing means operatively connected to said vertically extending supports.

20. A machine as recited in claim 18 wherein each said add-on section further comprises a return idler roller supported by said vertically extending supports and mounted below said trough-forming roller, and engaging said conveyor belt.

21. A machine as recited in claim 20 further comprising readily detachable means for connection said return idler roller and said trough-forming roller of each section to said vertically extending supports.

22. A machine as recited in claim 18 wherein each said trough-forming roller comprises a flexible core having a plurality of segmented resilient roller members supported thereon.

23. A machine as recited in claim 18 further comprising a frame member having lifting means associated therewith, said frame member and lifting means adapted to lower one of said add-on sections into operative relationship with said conveyor belt and provide for attachment of said shafts to a power source.

24. A method of continuously mining material from a bore and transporting it to the bore mouth utilizing an endless conveyor belt extending from the bore adjacent the cutting site to the bore mouth, comprising the steps of (a) cutting material in the bore to lengthen the bore, (b) scooping the cut material and funnelling it onto the conveyor belt, (c) supporting the conveyor belt at predetermined lengths therealong, (d) adding supporting sections for the conveyor belt at the bore mouth as the bore lengthens, (e) providing the necessary length of conveyor belt as the bore lengthens so that the conveyor belt always extends from adjacent the cutting site to the bore mouth, and (f) transporting the mined material from the cutting site to the bore mouth with the conveyor belt.

25. A method as recited in claim 24 wherein said steps of adding supporting sections and providing more conveyor belt are accomplished without interruption of the mined material conveying operation of the conveyor belt.

26. A method as recited in claim 24 wherein a power source for effecting cutting and advancing the conveyor belt in response to bore lengthening is provided at the bore mouth, at least one shaft extending from the bore mouth to the cutting site, and wherein said step of adding supporting sections to the conveyor belt at the bore mouth as the bore lengthens is accomplished simultaneously with the step of providing add-on sections for the at least one shaft so that the shaft extends from the bore mouth to the cutting site.

* * * * *